US006305538B1

(12) United States Patent
Jackson

(10) Patent No.: US 6,305,538 B1
(45) Date of Patent: Oct. 23, 2001

(54) PROTECTIVE CASING HAVING AN IMPROVED CLOSURE

(75) Inventor: Terry R. Jackson, Bozeman, MT (US)

(73) Assignee: William R. Heckerman, Jackson, WY (US)

( * ) Notice: Subject to any disclaimer, the term of this patent is extended or adjusted under 35 U.S.C. 154(b) by 743 days.

(21) Appl. No.: 08/887,453

(22) Filed: Jul. 2, 1997

Related U.S. Application Data

(63) Continuation of application No. 08/514,403, filed on Aug. 11, 1995, now abandoned.

(51) Int. Cl.[7] ..... B65D 85/38

(52) U.S. Cl. ..... 206/316.3; 206/316.1; 224/909

(58) Field of Search ..... 206/305, 316.1–316.3, 206/320, 523, 524; 150/150, 154, 165; 224/908, 909

(56) References Cited

U.S. PATENT DOCUMENTS

| | | | | |
|---|---|---|---|---|
| 2,478,267 | * | 8/1949 | Hickler | 206/316.3 |
| 2,868,254 | * | 1/1959 | Saad | 150/151 |
| 3,281,106 | * | 10/1966 | Bogdanovich | 206/316.3 |
| 3,782,614 | | 1/1974 | Campisi . | |
| 4,210,186 | | 7/1980 | Belenson . | |
| 4,232,808 | | 11/1980 | Gray . | |
| 4,421,150 | | 12/1983 | Masters . | |
| 4,431,041 | | 2/1984 | Leiserson . | |
| 4,545,414 | | 10/1985 | Baum . | |
| 4,629,651 | | 12/1986 | Davis . | |
| 4,865,191 | | 9/1989 | Easter . | |
| 4,923,060 | | 5/1990 | Breslau . | |
| 5,016,797 | | 5/1991 | Rowledge . | |
| 5,101,974 | * | 4/1992 | Alwitt | 206/316.2 |
| 5,150,824 | | 9/1992 | Alvarez et al. . | |
| 5,170,919 | | 12/1992 | Desantis et al. . | |
| 5,205,448 | * | 4/1993 | Kester et al. | 206/316.2 |
| 5,320,261 | | 6/1994 | Andersen . | |

FOREIGN PATENT DOCUMENTS

| | | | | |
|---|---|---|---|---|
| 577582 | * | 1/1994 | (GB) | 206/316.3 |

* cited by examiner

*Primary Examiner*—Luan K. Bui
(74) *Attorney, Agent, or Firm*—Pillsbury Winthrop LLP

(57) ABSTRACT

A protective casing is made from a resiliently stretchable material, such as neoprene rubber or the like, and is adapted to retain an article based on the stretchability of the constituent material. In use, a portion of the casing is inverted, or turned inside out, utilizing the resiliency of the material used, so as to permit an article to be inserted into or taken from the casing. To "close" the casing, the previously inverted portion of the casing is stretchingly reinverted, particularly so as to retainingly cover an end portion of the article protruding from the casing.

15 Claims, 4 Drawing Sheets

PROTECTIVE CASING HAVING AN IMPROVED CLOSURE

This is a continuation of application Ser. No. 08/514,403, filed on Aug. 11, 1995, which was abandoned.

BACKGROUND OF THE INVENTION

Field of the Invention

The present invention relates to protective casings for articles. The present invention is particularly applicable to protective casings for articles which are commonly transported on a user's person, for example, such as binoculars, field spotting scopes, cameras, detachable camera lens, and personal audio equipment (such as stereo tape cassette players and personal compact disc players).

Description of Related Art

Certain types of protective casings for protecting articles therein are known.

In general, protective cases are known in which an article is inserted in a main portion of the case. The case is thereafter closed with a closing portion which is independent of the main portion or attached thereto. The closing portion is usually hingedly attached to the main portion, or is independent of the main portion and is press-fit thereto. See, for example, the binocular case disclosed by Hickler in U.S. Pat. No. 2,478,267.

Similarly, Campisi (U.S. Pat. No. 3,782,614) discloses a binocular pocket attached to a garment. Campisi's binocular pocket is made from a fabric pocket, and has a separate closure flap sewed thereto.

Easter (U.S. Pat. No. 4,865,191) discloses a binocular cover. Easter's cover is initially strapped around the binocular lenses. Next, the remainder of the cover, which is essentially a skirt having an elastic provided at a periphery thereof, is pulled over the binoculars. The elastic provided at the edge of the skirt constricts the opening of the skirt to retain the binoculars therein.

Alwitt (U.S. Pat. No. 5,101,974) discloses a "self-latching" camera case for a camera having a body and a lens protruding therefrom. The camera is initially inserted into a main holding pocket, which includes a portion for protrudingly receiving the camera lens. The camera case, as disclosed, includes a closure flap which extends from a side of the case opposite to the lens receiving portion. The flap is foldable over the opening of the main holding pocket, in a direction towards the lens receiving portion of the case. The closure flap has a slit formed therethrough. The closure flap is secured in its closed position by extending the lens receiving portion through the slit formed in closure flap.

In the above-noted examples, all of the disclosed devices rely on additional parts or relatively complex arrangements to close the respective casings—straps in Hickler, a hook and loop fabric closure in Campisi, an elastic band in Easter, and physical interengagement in Alwitt.

SUMMARY OF THE INVENTION

The present invention is directed to a casing for an article which is made from a resiliently stretchable material. This use of a resiliently stretchable material enables the casing to be simply and reliably closable.

According to the present invention, a casing is provided which is characteristically made from a resiliently stretchable material. The casing has a plurality of wall portions which collectively define a space for insertingly receiving an article. The casing has an access opening, such as a slit, adjacent to, but spaced away from, an end of the casing. This opening is formed in only a portion of the periphery of the casing.

Because the casing is made from a stretchable material, the end of the casing adjacent to the access opening can be inverted, or turned "inside out", at the access opening to permit an article to be inserted or removed from the casing. With the article disposed within the casing, the end of the casing adjacent to the access opening can be reinverted to its original form. In doing so, the end of the casing being reinverted is stretchingly pulled over a protruding end of the article therein so as to assuredly retain the article within the casing.

Thus, the casing according to the present invention relies on the intrinsic elasticity of the material from which it is made in order to effect closure of the casing. Thus, additional parts, such as hinges, straps, or the like, and complicated interengagements, such as in Alwitt, are not necessary. This simplicity directly leads to less expensive manufacture and increased ease of use.

The resiliently stretchable material used to manufacture the casing is also preferably sufficiently resiliently compressible so as to protect from external impact damage and shock.

Other objects, features, and characteristics of the present invention, as well as methods of operation and function of the related elements of structure, and the combination of parts and economies of manufacture, will become more apparent upon consideration of the following detailed description and the appended claims with reference to the accompanying drawings, all of which form a part of this specification.

BRIEF DESCRIPTION OF THE DRAWINGS

It is emphasized that the accompanying figures merely illustrate examples of the present invention and should not be construed to limit the scope of the invention. More particularly, for the purposes of illustration, the present invention will be described using examples of casings for binoculars and for detachable lenses for single-lens reflex cameras. However, as noted above, the present invention is applicable to a variety of casings for articles which need to be protected from external impact and shock and which need to be easily accessible.

In the accompanying drawings:

'FIG. 2(*b*) is a perspective view of the casing seen in FIG. 2(*a*), with the casing shown in an open disposition;

FIG. 3(*c*) is a side cross-sectional view corresponding to FIG. 3(*b*).

DETAILED DESCRIPTION OF PREFERRED EMBODIMENTS

Figure 1B:
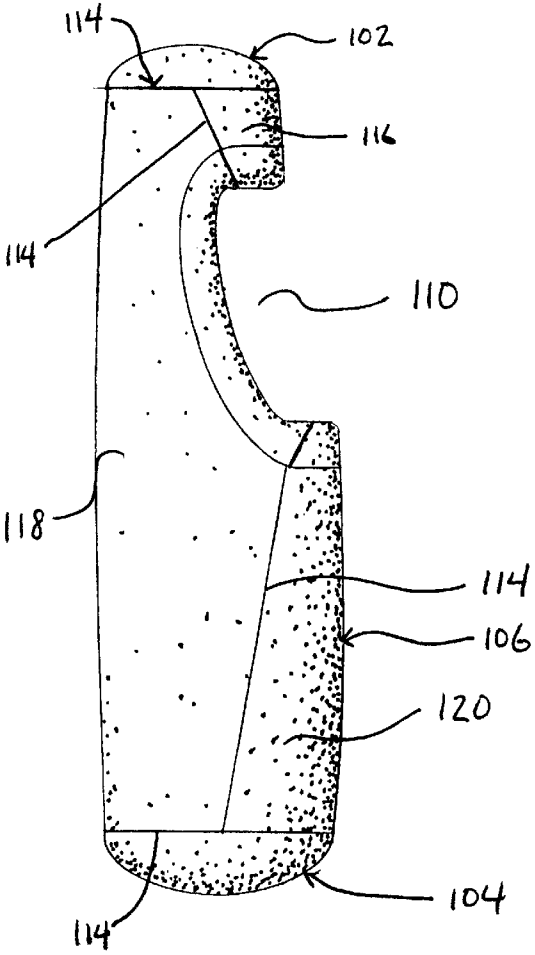
FIGS. 1(*a*) and 1(*b*) are front and side views of a casing for holding a pair of binoculars, according to the present invention.
Figure 1A:
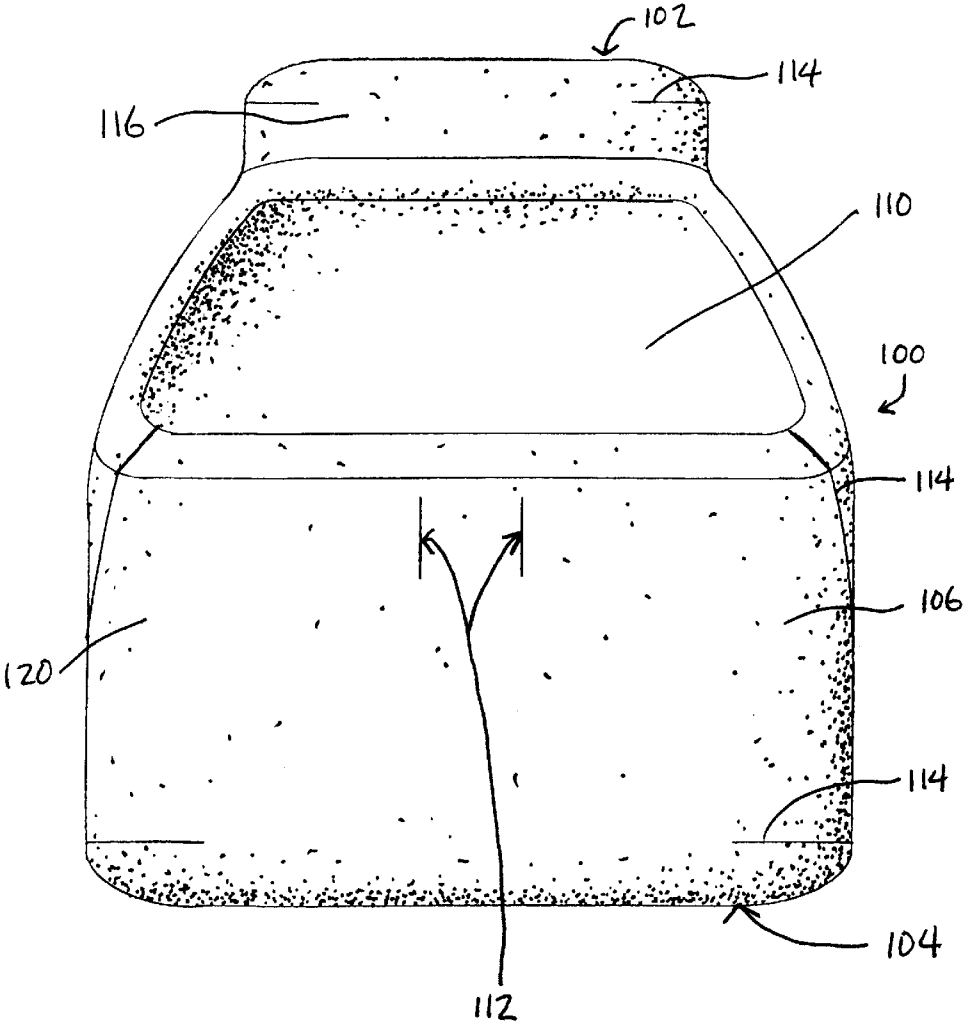

FIGS. 1(*a*) and 1(*b*) are front and side views, respectively, of a casing 100 according to the present invention and adapted to hold a pair of standard binoculars therein.

As noted above, the casing according to the present invention is made from a resiliently stretchable material.

Furthermore, this material is preferably also sufficiently compressibly resilient to absorb commonly occurring mechanical shocks and impact, so as to protect the article held within the casing. Neoprene rubber of sufficient thickness is a suitable material.

The casing 100 generally includes a first end wall portion 102, a second end wall portion 104 opposite the first end wall portion, and a peripheral wall portion 106. The peripheral wall portion 106 is provided with an access opening 110, through which the pair of binoculars (not seen here) in inserted into and removed from the casing 100.

The casing 100 is preferably provided with a way to carry the casing on a user's person. For example, as seen in FIG. 1(*a*), parallel slits 112, which can receive a belt or strap therethrough (not seen here), are provided. The slits 112 (or other means for carrying the casing) are preferably provided on the same side of the casing 100 as the access opening 110, so that the access opening is advantageously shielded against the user's body.

The casing 100 may be manufactured, for example, by cutting a single sheet portion of, for example, neoprene rubber, into a shape which can be folded into the general shape of the casing 100, whereby adjoining seams 114 are fixed by, for example, stitching, adhesive, or a combination of stitching and adhesive. Any known adhesive may be used, depending on its chemical bonding compatibility with the material used to form the casing. In this case, the single sheet portion includes a first front peripheral wall portion 116, first end wall portion 102, a rear peripheral wall portion 118, second end wall portion 104, and a second front peripheral wall portion 120. Accordingly, as seen in FIG. 1(*a*), a continuity exists between first front peripheral wall portion 116 and first end wall portion 102, and between second front peripheral wall portion 120 and second end wall portion 104. Similar continuities exist between the rear peripheral wall portion 118 and first and second end wall portions 102, 104, respectively, although such cannot be seen in the drawings.

Alternatively, the first and second end wall portions and the peripheral wall portions may be made from independent material pieces which are joined, as before, for example, by stitching and/or adhesive. Furthermore, the peripheral wall portion may be made of subpieces, such as front and rear portions, which again, are joined with the other material pieces to form the casing. However, this construction is less preferred than using a material portion which is at least partially continuous. The previously-described construction is relatively stronger because there are fewer seams and more continuous portions of material.

Figure 2A:
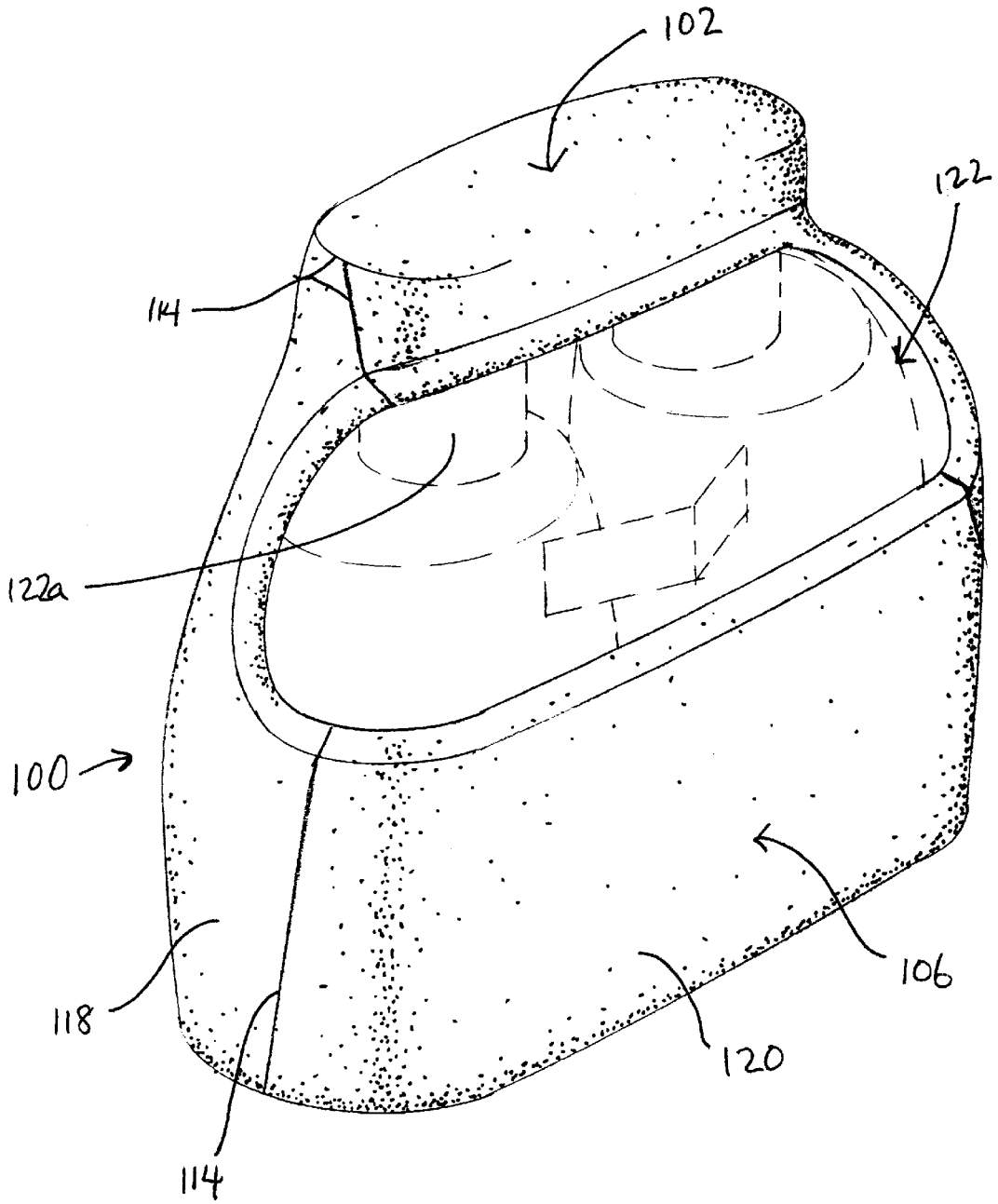
FIG. 2(*a*) is a perspective view of the casing seen in FIGS. 1(*a*) and 1(*b*), with the casing closed.
Figure 2B:
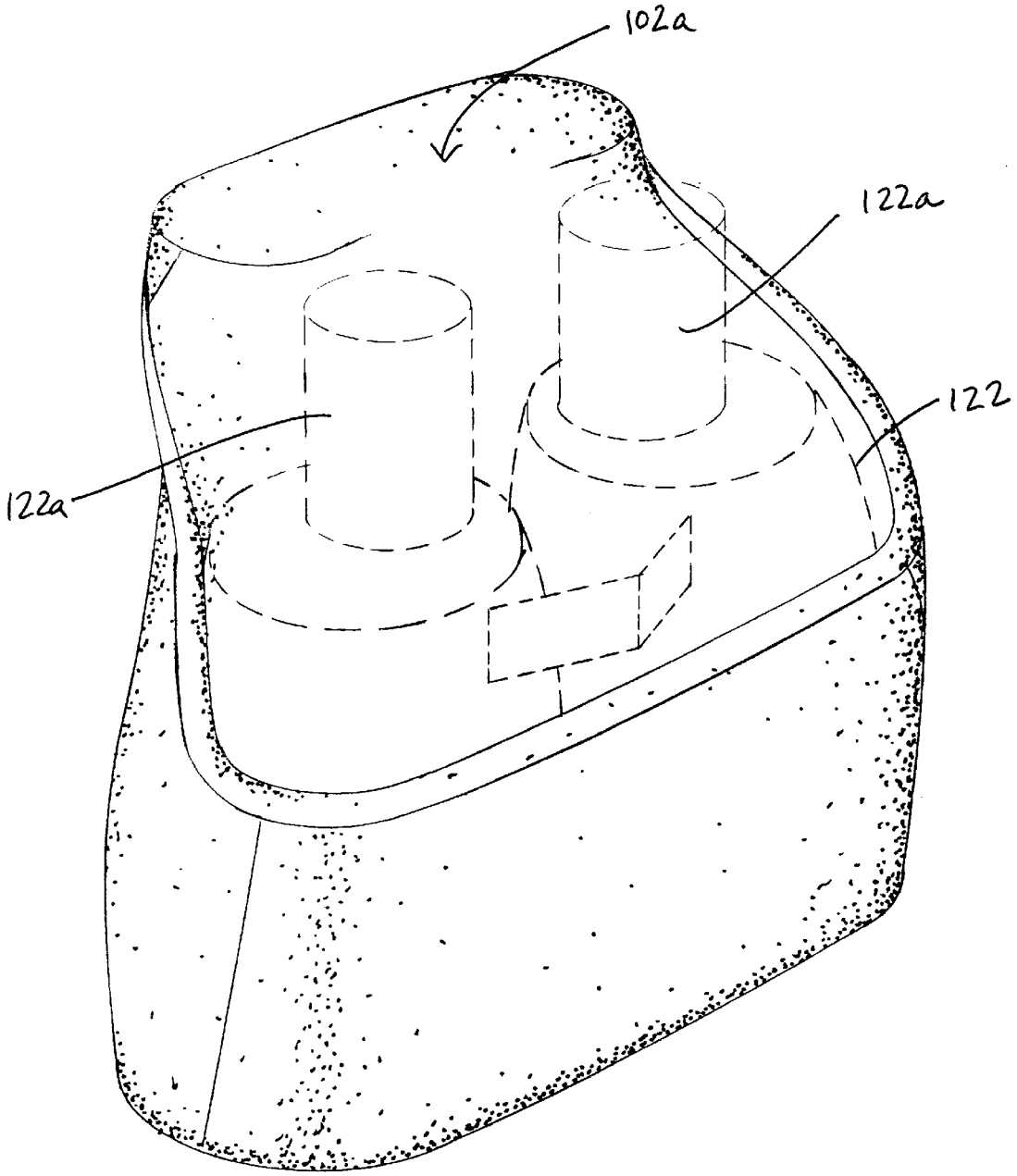

FIG. 2(*a*) illustrates a pair of binoculars 122, shown in phantom, enclosed in casing 100, with the casing 100 being it its closed disposition. Attention is drawn to the orientation of the pair of binoculars 122 within the casing 100. The pair of binoculars 122 is inserted into the casing 100 with its objective lenses (not visible here) adjacent to the second end wall portion 104 (not visible in FIG. 2(*a*)), and with its eyepieces 122*a* disposed adjacent to the first end wall portion 102. As can be seen in FIG. 2(*a*), the pair of binoculars 122 is held within the casing 100 by what is effectively an engagement of the first end wall portion 102 and adjoining portions of the peripheral wall portion 106 with the eyepieces 122*a*.

Attention is further drawn to the substantial conformance of casing 100 to the pair of binoculars 122.

FIG. 2(*b*) illustrates casing 100, with the pair of binoculars 122 disposed therein, with the casing 100 in its open disposition. The upper portion of the casing 100, including first end wall portion 102 and adjoining portions of peripheral wall portion 106, has been resiliently stretched so that it can be disengaged from the eyepieces 122*a*. According to the present invention, the upper portion of the casing 100 is substantially inverted, or turned inside out, utilizing the resilient stretchability of the material used to make the casing 100. Accordingly, in FIG. 2(*b*), an interior surface 102*a* of the first end wall portion can be seen.

Certain reference numerals have been omitted from the description of FIGS. 2(*a*) and 2(*b*) for clarity.

Figure 3A:
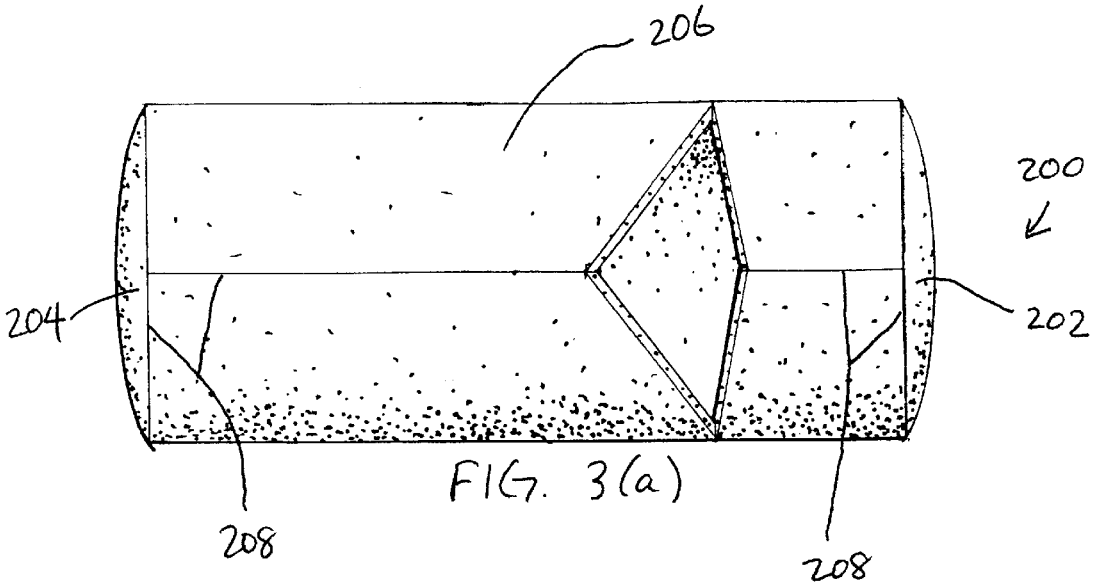
FIGS. 3(*a*) and 3(*b*) are front and side views of a casing for a detachable camera lens according to the present invention.
Figure 3B:
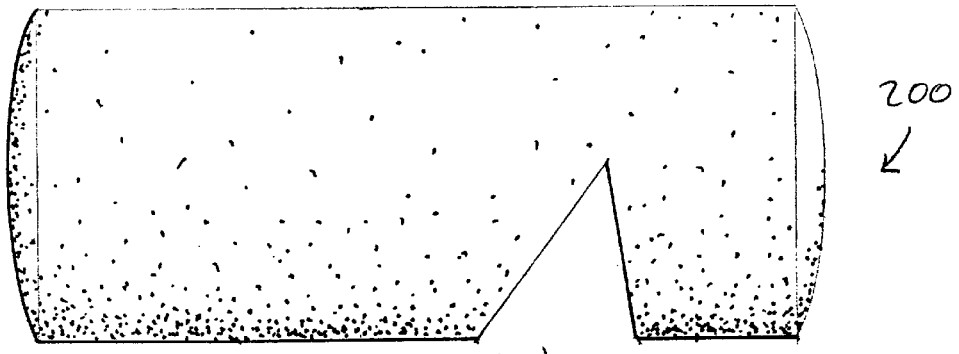
Figure 3C:
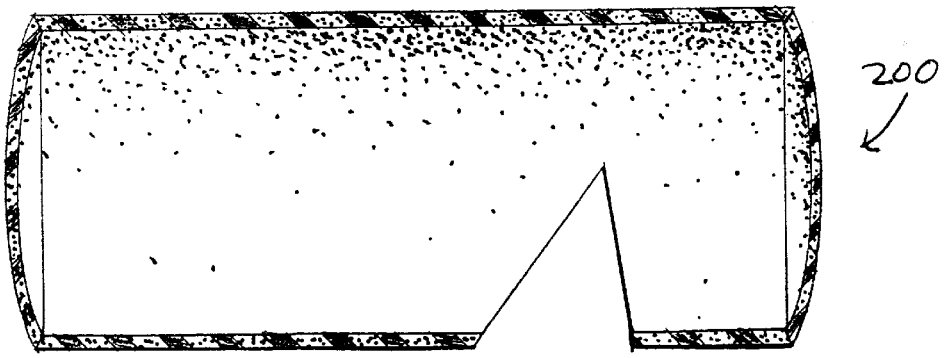

FIGS. 3(*a*), 3(*b*), and 3(*c*) illustrate another example of a protective casing according to the present invention. In this instance, casing 200 is adapted to house a detachable lens for a 35 mm camera.

FIG. 3(*a*) is a front view of the casing 200. Like the binoculars casing described above, casing 200 includes a first end wall portion 202, a second end wall portion 204, and a peripheral wall portion 206 extending therebetween. In this example, the casing 200 is formed from a single portion of suitably resilient material which has a substantially rectangular portion for forming the peripheral wall portion 206, and first and second material portions continuous therewith for forming the first and second end wall portions 202, 204. The edges of the material portion are joined at seams 208. Again, any known method may be used to bind the seams 208, such as stitching and/or adhesive. It is noted that the continuity of material between the peripheral wall portion and first and second end wall portions, respectively is on the opposite side of the view seen in FIG. 3(*a*) and is therefore not visible.

In general, the same manufacturing considerations set forth above with respect to the binoculars casing apply here and will therefore not be repeated.

While the invention has been described in connection with what is presently considered to be the most practical and preferable embodiments, it is to be understood that the invention is certainly not limited to these disclosed embodiments, but, on the contrary, is intended to cover various modifications and equivalent arrangements included within the spirit and scope of the appended claims.

What is claimed is:

1. A protective casing for an article, comprising:

a first end wall;

a second end wall; and a peripheral wall extending between said first and second end walls, said peripheral wall being provided with an access opening formed therethrough which is adjacent to, but spaced away from, said first end wall, wherein said first and second end walls and said peripheral wall are made from a resiliently compressible and stretchable material, wherein said first and second end walls and said peripheral wall collectively define a space in which the article is resiliently held, and wherein the first end wall and an adjacent portion of the peripheral wall are configured to be stretchingly inverted and allow for insertion of an article into a hollow space defined by the second end wall and an uninverted portion of the peripheral wall shaped similar to the article shape, and the first end wall and the adjacent portion of the peripheral wall are also configured to be stretchingly reinverted so as to cover a corresponding and exposed end of the article, the reinverted first wall and the adjacent portion of the peripheral wall being configured to resiliently adopt a shape substantially conformal with the end of the article.

2. The casing as claimed in claim 1, wherein said first, second and peripheral walls are made from an elastomeric rubber.

3. The casing as claimed in claim 2, wherein said elastomeric rubber is neoprene rubber.

4. The casing as claimed in claim 1, further including a belt-engaging carrying portion.

5. The casing as claimed in claim 4, wherein said belt-engaging carrying portion is a loop formed by two parallel and laterally spaced apart slits formed in said peripheral wall and each lying along a direction extending between said first and second end walls.

6. The casing as claimed in claim 1, wherein at least one of said first end wall, said second end wall, and said peripheral wall is independent of the other said wall portions.

7. The casing as claimed in claim 6, wherein said at least one independent wall portion is joined to the other said wall portions by one of sewing and adhesive.

8. The casing as claimed in claim 1, wherein said first and second end walls and said peripheral wall, having said access opening formed therein, are formed by a single sheet of said resiliently compressible and stretchable material, said sheet having:

a first front peripheral wall;

a second end wall integral with said first front peripheral wall;

a rear peripheral wall integral with said second end wall and opposite said first front peripheral wall;

a first end wall integral with said rear peripheral wall; and a second front peripheral wall integral with said first end wall, said first and second front peripheral walls being spaced from one another so as to define said access opening therebetween.

9. The casing as claimed in claim 1, wherein said first and second end walls and said peripheral wall portion are integrally formed.

10. The casing as claimed in claim 1, wherein said first end wall and the adjacent portion of said peripheral wall enclose a volume of said hollow interior space that is less than that enclosed by said second end wall and the adjacent portion of said peripheral wall.

11. A method of use for a casing for protecting an article held substantially conformally therein, the casing including:

a first end wall;

a second end wall; and a peripheral wall extending between said first and second end walls, said peripheral wall being provided with an access opening formed therethrough which is adjacent to, but spaced away from, said first end wall, wherein said first and second end walls and said peripheral wall are made from a resiliently compressible and stretchable material, wherein said first and second end walls, and said peripheral wall collectively define a space in which the article resiliently held, the method of use comprising;

with the first end wall and an adjacent portion of the peripheral wall being stretchingly inveiled, inserting an article into a hollow space defined by the second end wall and an uninverted portion of the peripheral wall to be shaped similar to the article shape; and stretchingly reinverting the first end wail and the adjacent portion of the peripheral wall so as to cover a corresponding and exposed end of the article, the reinverted first wall and the adjacent portion of the peripheral wall resiliently adopting a shape substantially conformal with the end of the article.

12. The method as claimed in claim 11, wherein said first end wall and the adjacent portion of said peripheral wall enclose a volume of said hollow interior space that is less than that enclosed by said second end wall and the adjacent portion of said peripheral wall.

13. In combination, an article having an end; and a shaped casing for protecting the article, said casing including a first end wall, a second end wall and a peripheral wall extending between said first and second end walls, said peripheral wall being provided with an access opening formed therethrough which is adjacent to, but spaced away from, said first end wall, wherein said first and second end walls and said peripheral wall are made from a resiliently compressible and stretchable material and said first and second end walls and said peripheral wall collectively define a space in which the article is resiliently held, and wherein the first end wall and an adjacent portion of the peripheral wall are configured to be stretchingly inverted and allow for insertion of an article into a hollow space defined by the second end wall and an uninverted portion of the peripheral wall shaped similar to the article shape, and wherein the first end wall and the adjacent portion of the peripheral wall are also configured to be stretchingly reinverted so as to cover a corresponding and exposed end of the article, the reinverted first wall and the adjacent portion of the peripheral wall being configured to resiliently adopt a shape substantially conformal with the end of the article.

14. A protective casing for an article, comprising:

a first end wall;

a second end wall;

a belt-engaging carrying portion;

a peripheral wall secured to, extending between and at least partially interconnecting said first and second end walls so as to collectively define a shape retaining hollow interior space in which the article is resiliently held and an access opening formed in said casing adjacent one of said first and second end walls directly exposing the interior space, said first and second end walls and said peripheral wall comprise a resiliently compressible and stretchable material, the article being accessible by stretchingly inverting said casing adjacent one of said first and second end walls and a portion of said peripheral wall away from a position that conformingly enclosed at least a portion of the article, and reinverting such stretched structure so as to again conformingly enclose and contain the article while maintaining the open state of the access opening.

15. The casing as claimed in claim 14, wherein said belt-engaging carrying portion is a loop formed by two parallel and laterally spaced apart slits formed in said peripheral wall and each lying along a direction extending between said first and second end walls.

* * * * *